US009427797B2

(12) United States Patent
Sugiura et al.

(10) Patent No.: US 9,427,797 B2
(45) Date of Patent: Aug. 30, 2016

(54) UP-DRAWING CONTINUOUS CASTING APPARATUS AND UP-DRAWING CONTINUOUS CASTING METHOD

(71) Applicant: Toyota Jidosha Kabushiki Kaisha, Toyota-shi Aichi-ken (JP)

(72) Inventors: Naoaki Sugiura, Takahama (JP); Shoichi Tsuchiya, Toyota (JP); Yusuke Yokota, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 5 days.

(21) Appl. No.: 14/638,348

(22) Filed: Mar. 4, 2015

(65) Prior Publication Data

US 2015/0251245 A1 Sep. 10, 2015

(30) Foreign Application Priority Data

Mar. 10, 2014 (JP) ..... 2014-046046

(51) Int. Cl.

| | |
|---|---|
| ***B22D 11/14*** | (2006.01) |
| ***B22D 11/01*** | (2006.01) |
| ***B22D 11/12*** | (2006.01) |
| ***B22D 11/22*** | (2006.01) |

(52) U.S. Cl.

CPC ..... *B22D 11/142* (2013.01); *B22D 11/01* (2013.01); *B22D 11/1206* (2013.01); *B22D 11/141* (2013.01); *B22D 11/145* (2013.01); *B22D 11/225* (2013.01)

(58) Field of Classification Search

CPC ... B22D 11/01; B22D 11/141; B22D 11/225; B22D 11/1206; B22D 11/145; B22D 11/142

See application file for complete search history.

(56) References Cited

U.S. PATENT DOCUMENTS

| | | | |
|---|---|---|---|
| 6,217,803 | B1 | 4/2001 | Uozumi |
| 2013/0171021 | A1 | 7/2013 | Yaokawa et al. |

FOREIGN PATENT DOCUMENTS

| | | | |
|---|---|---|---|
| JP | 63-199050 | A | 8/1988 |
| JP | 09-248657 | A | 9/1997 |
| JP | 2005-324203 | A | 11/2005 |
| JP | 2012-061518 | A | 3/2012 |
| JP | 2014-104467 | A | 6/2014 |

*Primary Examiner* — Kevin P Kerns

*Assistant Examiner* — Steven Ha

(74) *Attorney, Agent, or Firm* — Dinsmore & Shohl LLP

(57) ABSTRACT

An up-drawing continuous casting apparatus according to one aspect of the invention includes a molten metal holding furnace that holds molten metal; a shape determining member that is arranged near a molten metal surface of the molten metal held in the molten metal holding furnace, and that determines a sectional shape of a cast casting by the molten metal passing through the shape determining member, the shape determining member including a pattern provided on an upper surface of the shape determining member; an imaging portion configured to capture an image of the pattern that is reflected onto both retained molten metal that has passed through the shape determining member, and the casting formed by the retained molten metal solidifying; an image analyzing portion configured to determine a solidification interface from the image; and a casting controlling portion configured to change a casting condition.

8 Claims, 14 Drawing Sheets

WITHOUT PATTERN P WITH PATTERN P

UP-DRAWING CONTINUOUS CASTING APPARATUS AND UP-DRAWING CONTINUOUS CASTING METHOD

INCORPORATION BY REFERENCE

The disclosure of Japanese Patent Application No. 2014-046046 filed on Mar. 10, 2014 including the specification, drawings and abstract is incorporated herein by reference in its entirety.

BACKGROUND OF THE INVENTION

1. Field of the Invention

The invention relates to an up-drawing continuous casting apparatus and an up-drawing continuous casting method.

2. Description of Related Art

Japanese Patent Application Publication No. 2012-61518 (JP 2012-61518 A) proposes a free casting method as a groundbreaking up-drawing continuous casting method that does not require a mold. As described in JP 2012-61518 A, a starter is first dipped into the surface of molten metal (a molten metal surface), and then when the starter is drawn up, molten metal is also drawn up following the starter by surface tension and the surface film of the molten metal. Here, a casting that has a desired sectional shape is able to be continuously cast by drawing up the molten metal through a shape determining member arranged near the molten metal surface, and cooling the drawn up molten metal.

With a normal continuous casting method, the sectional shape and the shape in the longitudinal direction are both determined by a mold. In particular, with a continuous casting method, the solidified metal (i.e., the casting) must pass through the mold, so the cast casting takes on a shape that extends linearly in the longitudinal direction. In contrast, the shape determining member in the free casting method determines only the sectional shape of the casting. The shape in the longitudinal direction is not determined. Therefore, castings of various shapes in the longitudinal direction are able to be obtained by drawing the starter up while moving the starter (or the shape determining member) in a horizontal direction. For example, JP 2012-61518 A describes a hollow casting (i.e., a pipe) formed in a zigzag shape or a helical shape, not a linear shape in the longitudinal direction.

The inventors discovered the problem described below. With the free casting method described in JP 2012-61518 A, the molten metal drawn up through the shape determining member is cooled and solidified by cooling gas, so a solidification interface is positioned above the shape determining member. The position of this solidification interface directly affects the dimensional accuracy and surface quality of the casting. Therefore, it is essential to detect the solidification interface and control it to within a predetermined reference range.

Here, the inventors have found that, because the surface of the drawn-up molten metal oscillates (more specifically, greatly fluctuates in short fluctuation cycles) and the surface of the casting formed by the molten metal solidifying does not oscillate much at all (more specifically, fluctuates little in long fluctuation cycles), the solidification interface can be determined based on whether there is oscillation. However, if the position of the solidification interface is low, oscillation of the drawn-up molten metal is small and is difficult to detect, so it is difficult to determine the solidification interface based on whether there is oscillation. As a result, if the position of the solidification interface is low, the solidification interface may not be able to be controlled to within an appropriate reference range.

SUMMARY OF THE INVENTION

The invention thus provides an up-drawing continuous casting apparatus and an up-drawing continuous casting method in which a solidification interface can be controlled to within an appropriate reference range even if the solidification interface is low, and which therefore obtain excellent dimensional accuracy and surface quality of a casting.

A first aspect of the invention relates to an up-drawing continuous casting apparatus that includes a holding furnace that holds molten metal; a shape determining member that is arranged above a molten metal surface of the molten metal held in the holding furnace, and that determines a sectional shape of a cast casting by the molten metal passing through the shape determining member, the shape determining member including a pattern provided on an upper surface of the shape determining member; an imaging portion configured to capture an image of the pattern that is reflected onto both retained molten metal that has passed through the shape determining member, and the casting formed by the retained molten metal solidifying; an image analyzing portion configured to determine a solidification interface from the image; and a casting controlling portion configured to change a casting condition when the solidification interface determined by the image analyzing portion is not within a predetermined reference range. With the up-drawing continuous casting apparatus according to this first aspect of the invention, the pattern provided on the upper surface of the solidification interface is reflected onto the molten metal that has passed through the shape determining member, so the brightness of the molten metal surface greatly changes with even the slightest oscillation of the molten metal. Therefore, the solidification interface is able to be determined even if the solidification interface is low and the oscillation of the molten metal is small. As a result, the solidification interface is able to be controlled to within an appropriate reference range even if the solidification interface is low.

A second aspect of the invention relates to an up-drawing continuous casting method that includes arranging a shape determining member that determines a sectional shape of a cast casting above a molten metal surface of molten metal held in a holding furnace, and drawing up the molten metal while passing the molten metal through the shape determining member, the shape determining member including a pattern provided on an upper surface of the shape determining member. This up-drawing continuous casting method also includes capturing an image of the pattern that is reflected onto both retained molten metal that has passed through the shape determining member, and the casting formed by the retained molten metal solidifying; determining a solidification interface from the image; and changing a casting condition when the determined solidification interface is not within a predetermined reference range. With the up-drawing continuous casting method according to this second aspect of the invention, the pattern provided on the upper surface of the solidification interface is reflected onto the molten metal that has passed through the shape determining member, so the brightness of the molten metal surface greatly changes with even the slightest oscillation of the molten metal. Therefore, the solidification interface is able to be determined even if the solidification interface is low and the oscillation of the molten metal is small. As a result, the solidification interface is able to be controlled to within an appropriate reference range even if the solidification interface is low.

The invention is thus able to provide an up-drawing continuous casting apparatus and an up-drawing continuous casting method in which a solidification interface can be controlled to within an appropriate reference range even if the solidification interface is low, and which therefore obtain excellent dimensional accuracy and surface quality of a casting.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, specific example embodiments to which the invention has been applied will be described in detail with reference to the accompanying drawings. However, the invention is not limited to these example embodiments. Also, the description and the drawings are simplified as appropriate to clarify the description.

First Example Embodiment

Figure 1:
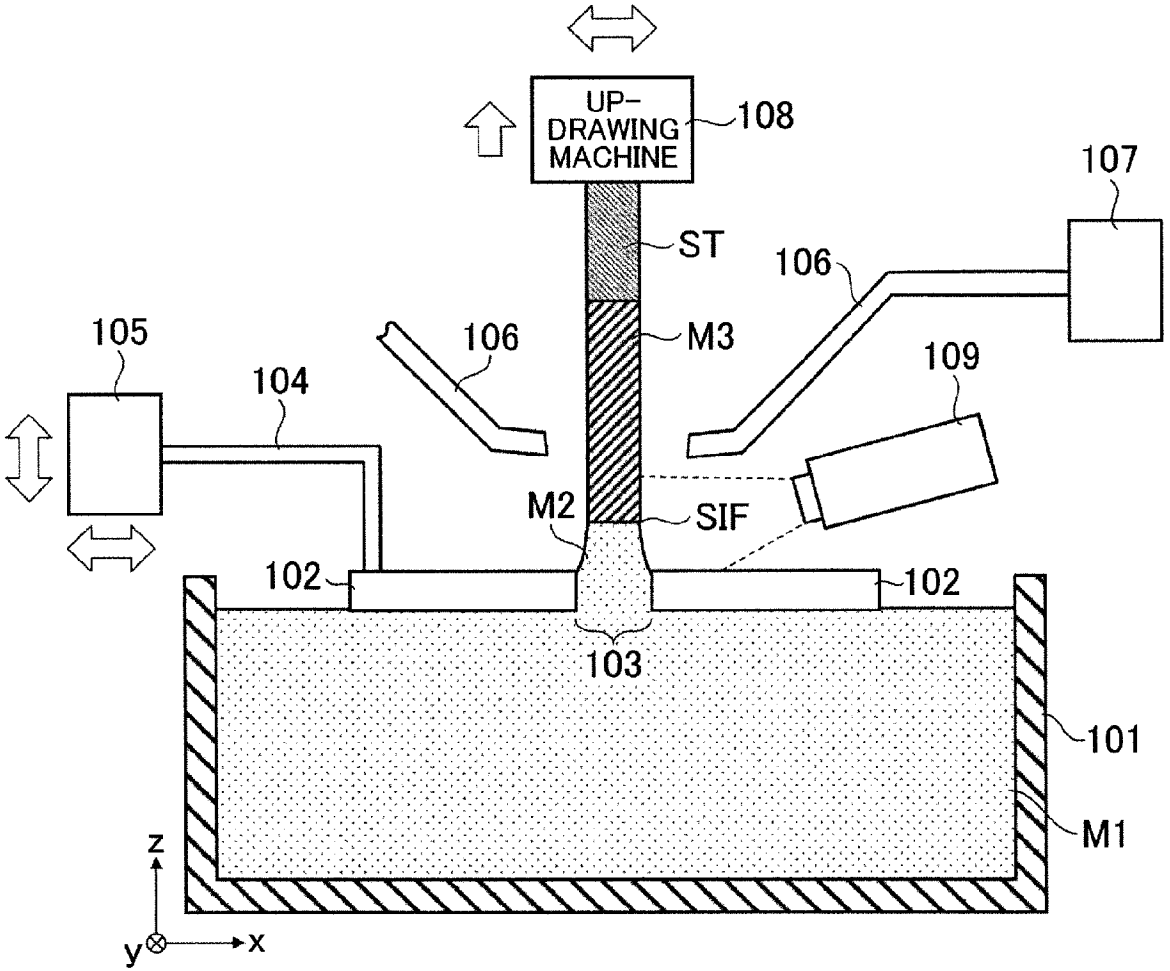
FIG. 1 is a sectional view showing a frame format of a free casting apparatus according to a first example embodiment of the invention.

First, a free casting apparatus (up-drawing continuous casting apparatus) according to a first example embodiment of the invention will be described with reference to FIG. 1. FIG. 1 is a sectional view showing a frame format of the free casting apparatus according to the first example embodiment. As shown in FIG. 1, the free casting apparatus according to the first example embodiment includes a molten metal holding furnace 101, a shape determining member 102, a support rod 104, an actuator 105, a cooling gas nozzle 106, a cooling gas supplying portion 107, an up-drawing machine 108, and an imaging portion (camera) 109. In FIG. 1, a right-handed xyz coordinate system is shown for descriptive purposes to illustrate the positional relationship of the constituent elements. The x-y plane in FIG. 1 forms a horizontal plane, and the z-axis direction is the vertical direction. More specifically, the plus direction of the z-axis is vertically upward.

The molten metal holding furnace 101 holds molten metal M1 such as aluminum or an aluminum alloy, for example, and keeps it at a predetermined temperature at which the molten metal M1 has fluidity. In the example in FIG. 1, molten metal is not replenished into the molten metal holding furnace 101 during casting, so the surface of the molten metal M1 (i.e., the molten metal surface level) drops as casting proceeds. However, molten metal may also be replenished into the molten metal holding furnace 101 when necessary during casting so that the molten metal surface level is kept constant. Here, the position of a solidification interface SIF can be raised by increasing a set temperature of the molten metal holding furnace 101, and lowered by reducing the set temperature of the molten metal holding furnace 101. Naturally, the molten metal M1 may be another metal or alloy other than aluminum.

The shape determining member 102 is made of ceramic or stainless steel, for example, and is arranged above the molten metal M1. The shape determining member 102 determines the sectional shape of a cast casting M3. The casting M3 shown in FIG. 1 is a solid casting (a plate) having a rectangular cross-section in the horizontal direction (hereinafter, simply referred to as "transverse section"). Naturally, the sectional shape of the casting M3 is not particularly limited. The casting M3 may also be a hollow casting of a round pipe or a square pipe or the like.

In the example in FIG. 1, a main surface (a lower surface) on a lower side of the shape determining member 102 is arranged contacting the molten metal surface. Therefore, an oxide film that forms on the surface of the molten metal M1 and foreign matter floating on the surface of the molten metal M1 are able to be prevented from getting mixed into the casting M3. However, the lower surface of the shape determining member 102 may also be arranged a predetermined distance away from the molten metal surface. When the shape determining member 102 is arranged away from the molten metal surface, heat deformation and erosion of the shape determining member 102 are inhibited, so the durability of the shape determining member 102 improves.

Figure 2:
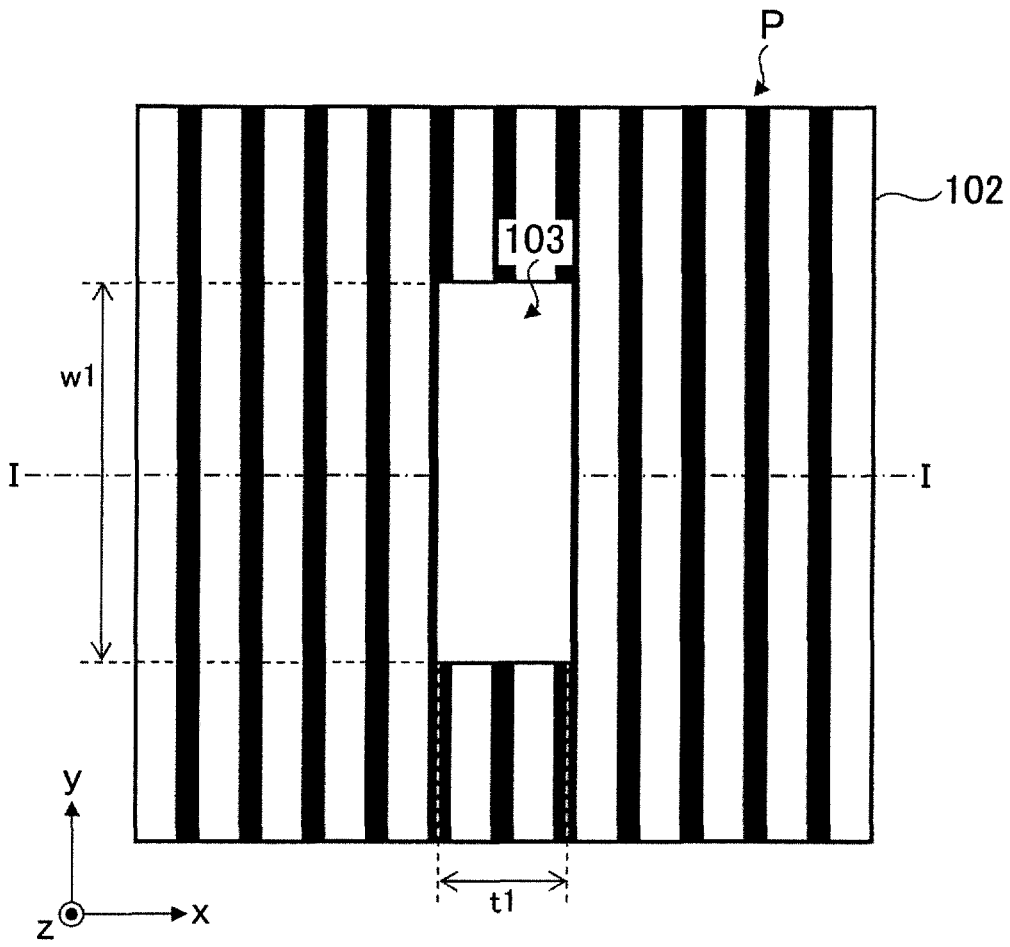
FIG. 2 is a plan view of a shape determining member according to the first example embodiment.

FIG. 2 is a plan view of the shape determining member 102 according to the first example embodiment. Here, the sectional view of the shape determining member 102 in FIG. 1 corresponds to a sectional view taken along line I-I in FIG. 2. As shown in FIG. 2, the shape determining member 102 has a rectangular planar shape, for example, and has a rectangular open portion (a molten metal passage portion 103) having a thickness t1 and a width w1 through which the molten metal passes in the center portion. The xyz coordinates in FIG. 2 match those in FIG. 1.

Furthermore, a pattern P is applied to an upper surface (i.e., the surface on the upper side) of the shape determining member 102. More specifically, a striped pattern P formed by a plurality of colors (black and white in this case) is applied to the upper surface of the shape determining member 102. The pattern P is preferably applied such that the pattern P has slimness (density) where the colors are enough to be able to be identified by an image analyzing portion 110. The pattern P is applied by applying heat resistance ink to the upper surface of the shape determining member 102, for example. The specific effects of the pattern P will be described later.

As shown in FIG. 1, after joining with a starter ST that has been dipped into the molten metal M1, the molten metal M1 is drawn up following the starter ST while maintaining its outer shape, by the surface tension and the surface film of the molten metal M1, and passes through the molten metal passage portion 103 of the shape determining member 102. By passing the molten metal M1 through the molten metal passage portion 103 of the shape determining member 102, external force is applied to the molten metal M1 from the shape determining member 102, such that the sectional shape of the casting M3 is determined. Here, the molten metal that is drawn up from the molten metal surface following the starter ST (or the casting M3 that is formed by the molten metal M1 drawn up following the starter ST solidifying) by the surface tension and the surface film of the molten metal M1 will be referred to as "retained molten metal M2". Also, the boundary between the casting M3 and the retained molten metal M2 is a solidification interface SIF.

The support rod 104 supports the shape determining member 102. The support rod 104 is connected to the actuator 105. The shape determining member 102 is able to move up and down (i.e., in the vertical direction; the z-axis direction) via the support rod 104, by the actuator 105. According to this kind of structure, the shape determining member 102 is able to be moved downward as the molten metal surface level drops as casting proceeds.

A cooling gas nozzle (a cooling portion) 106 is cooling means for spraying cooling gas (e.g., air, nitrogen, argon, or the like) supplied from the cooling gas supplying portion 107 at the casting M3 to cool the casting M3. The position of the solidification interface SIF is able to be lowered by increasing the flow rate of the cooling gas, and raised by reducing the flow rate of the cooling gas. The cooling gas nozzle 106 is also able to be moved up and down (i.e., in the vertical direction; in the z-axis direction) and horizontally (i.e., in the x-axis direction and the y-axis direction). Therefore, for example, the cooling gas nozzle 106 can be moved downward, in concert with the movement of the shape determining member 102, as the molten metal surface level drops as casting proceeds. Alternatively, the cooling gas nozzle 106 can be moved horizontally, in concert with horizontal movement of the up-drawing machine 108.

The casting M3 is formed by the retained molten metal M2 near the solidification interface SIF progressively solidifying from the upper side (i.e., a plus side in the z-axis direction) toward lower side (i.e., a minus side in the z-axis direction), by cooling the starter ST and the casting M3 with the cooling gas, while drawing the casting M3 up with the up-drawing machine 108 that is connected to the starter ST. The position of the solidification interface SIF is able to be raised by increasing the up-drawing speed with the up-drawing machine 108, and lowered by reducing the up-drawing speed. Also, the retained molten metal M2 is able to be drawn out diagonally by drawing the casting M3 up while moving the up-drawing machine 108 horizontally (in the x-axis direction and the y-axis direction). Therefore, the longitudinal shape of the casting M3 is able to be freely changed. The longitudinal shape of the casting M3 may also be freely changed by moving the shape determining member 102 horizontally, instead of by moving the up-drawing machine 108 horizontally.

The imaging portion 109 continuously monitors the area near the solidification interface SIF that is the boundary between the casting M3 and the retained molten metal M2, during casting. Here, the imaging portion 109 is arranged at a position and angle such that it is able to capture the pattern P reflected onto the surfaces of both the retained molten metal M2 and the casting M3 (or more preferably, the entire area used for image analysis). Also, the pattern P is applied to a position and area that satisfies this. As a result, the imaging portion 109 successively captures an image of not only the surfaces of both the retained molten metal M2 and the casting M3, but also of the pattern P reflected onto these surfaces. In the example in FIG. 1, the imaging portion 109 is arranged looking diagonally down and facing on the solidification interface SIF from above the solidification interface SIF. When it is known in advance that the position of the solidification interface SIF will change, the imaging portion 109 may also be configured to move according to this change. The solidification interface SIF is able to be determined from the image captured by the imaging portion 109, as will be described in detail later.

Figure 3:
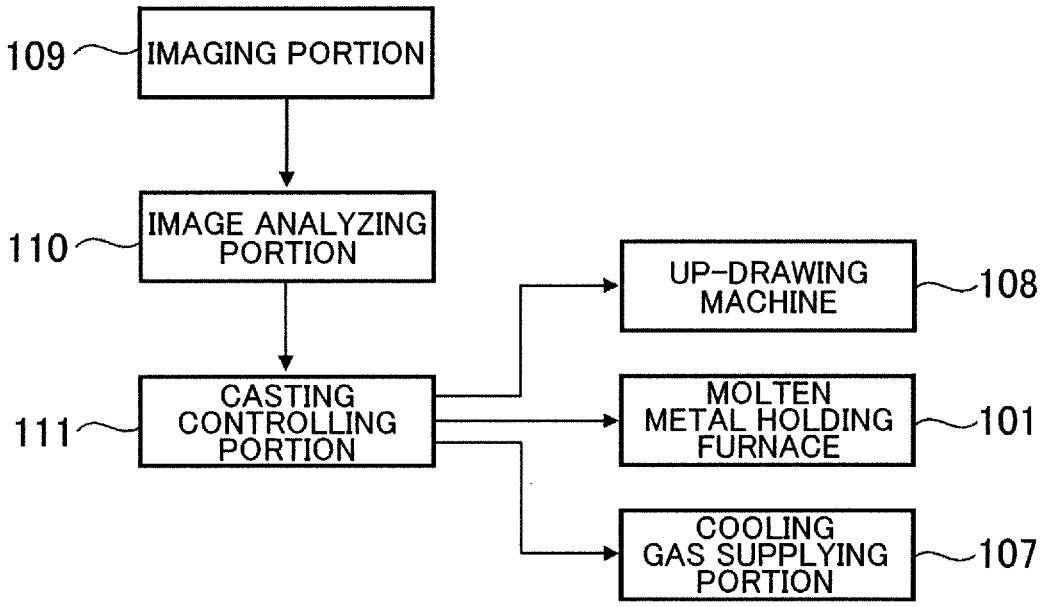
FIG. 3 is a block diagram of a solidification interface control system provided in the free casting apparatus according to the first example embodiment.

Next, a solidification interface control system provided in the free casting apparatus according to the first example embodiment will be described with reference to FIG. 3. FIG. 3 is a block diagram of the solidification interface control system provided in the free casting apparatus according to the first example embodiment. This solidification interface control system is designed to keep the position (height) of the solidification interface SIF within a predetermined reference range.

As shown in FIG. 3, this solidification interface control system includes the imaging portion 109, an image analyzing portion 110, a casting controlling portion 111, the up-drawing machine 108, the molten metal holding furnace 101, and the cooling gas supplying portion 107. The imaging portion 109, the up-drawing machine 108, the molten metal holding furnace 101, and the cooling gas supplying portion 107 have been described with reference to FIG. 1, so detailed descriptions of these will be omitted here.

The image analyzing portion 110 determines the solidification interface from an image captured by the imaging portion 109. More specifically, the image analyzing portion 110 compares a plurality of images captured in succession, and determines a location where a brightness value of reflected light changes greatly in short fluctuation cycles, to be the surface of the retained molten metal M2 which oscillates. On the other hand, the image analyzing portion 110 determines a location where the brightness value of the reflected light changes only slightly in long fluctuation cycles, i.e., a location where there is not much oscillation, to be the surface of the casting M3. As a result, the image analyzing portion 110 is able to determine the solidification interface based on whether there is oscillation (or more specifically, the fluctuation cycle of the oscillation and fluctuation range of the oscillation).

Here, as described above, the pattern P is applied to the upper surface of the shape determining member 102. This pattern P is reflected onto the retained molten metal M2, so the brightness of the surface of the retained molten metal M2 changes greatly when the retained molten metal M2 oscillates slightly. Therefore, the solidification interface is able to be determined even when the molten metal surface is low and oscillation of the molten metal surface is small.

Figure 4:
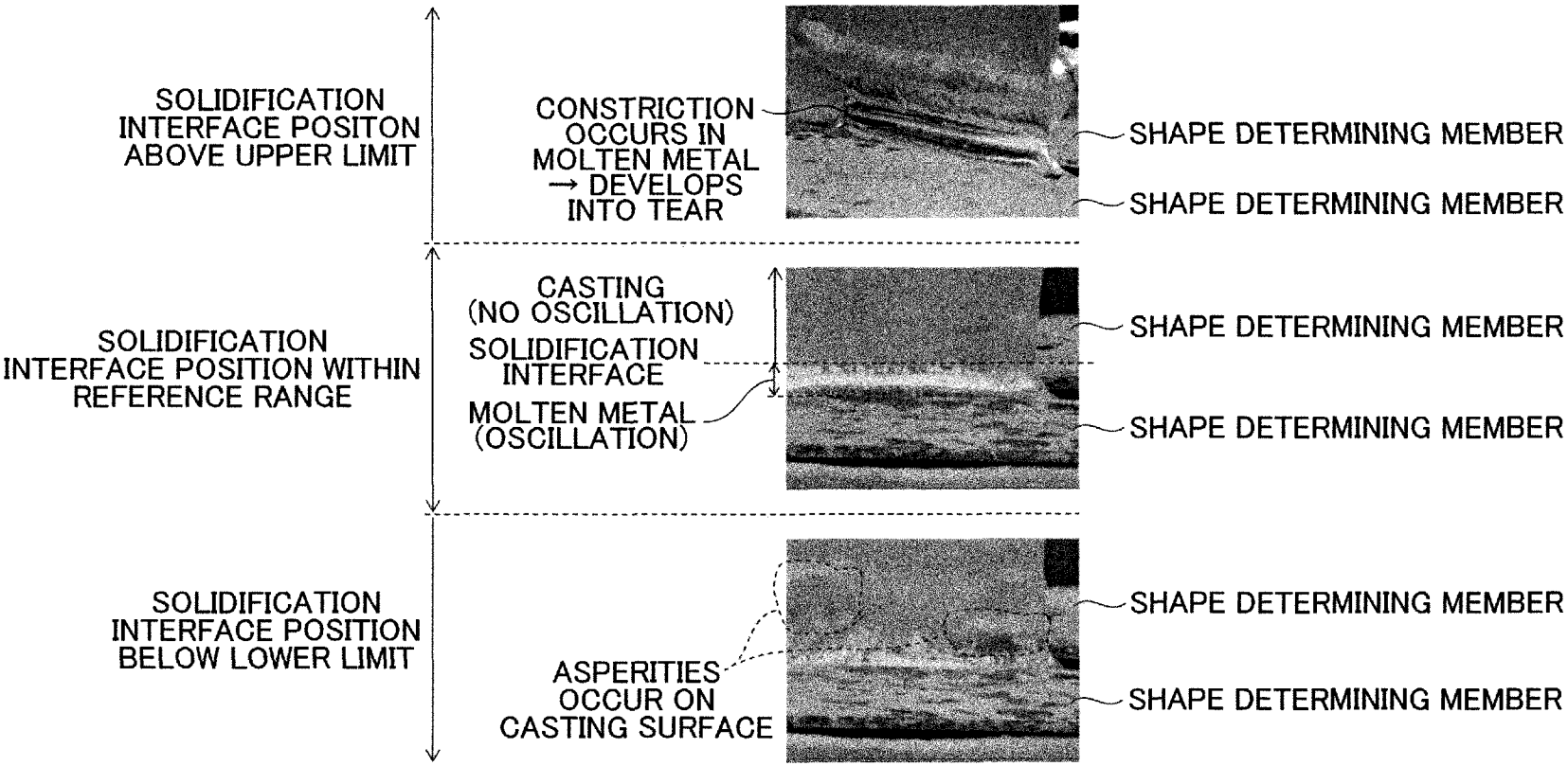
FIG. 4 is a view of three example images of an area near a solidification interface.

This will be described in more detail with reference to FIG. 4. FIG. 4 is a view of three example images of the area near the solidification interface. The example images in FIG. 4 are, in order from the top of FIG. 4, an example image of a case in which the position of the solidification interface is above an upper limit, an example image of a case in which the position of the solidification interface is within the reference range, and an example image of a case in which the position of the solidification interface is below a lower limit As shown in the example image in the center of FIG. 4, the image analyzing portion 110 determines a boundary portion between a region where oscillation is detected (i.e., molten metal), and a region where oscillation is so small that it is not detected (i.e., the casting), in the image captured by the imaging portion 109, to be the solidification interface, for example.

The casting controlling portion 111 includes a storing portion, not shown, that stores the reference range (the upper and lower limits) of the solidification interface position. Also, if the solidification interface determined by the image analyzing portion 110 is above the upper limit, the casting controlling portion 111 reduces the up-drawing speed of the up-drawing machine 108, lowers the set temperature of the molten metal holding furnace 101, or increases the flow rate of the cooling gas supplied from the cooling gas supplying portion 107. On the other hand, if the solidification interface determined by the image analyzing portion 110 is below the lower limit, the casting controlling portion 111 increases the up-drawing speed of the up-drawing machine 108, raises the set temperature of the molten metal holding furnace 101, or decreases the flow rate of the cooling gas supplied from the cooling gas supplying portion 107. Control of these three conditions may simultaneously change two or more conditions, but changing only one condition makes control easier, and is thus preferable. Also, the priority order of the three conditions may be set in advance, and they may be changed in order from that of the highest priority.

Next, the upper and lower limits of the solidification interface position will be described with reference to FIG. 4. As shown in the example images in FIG. 4, when the position of the solidification interface is above the upper limit, a "constriction" occurs in the retained molten metal M2 and develops into a "tear". The upper limit of the solidification interface position can be determined by changing the height of the solidification interface, and examining in advance whether a "constriction" occurs in the retained molten metal M2.

On the other hand, when the position of the solidification interface is below the lower limit, as shown in the example image at the bottom of FIG. 4, asperities occur on the surface of the casting M3 and become shape defects. The lower limit of the solidification interface position can be determined by changing the height of the solidification interface, and examining in advance whether asperities occur on the surface of the casting M3. These asperities are thought to be solidified flakes that have formed inside the shape determining member 102 due to the solidification interface being too low.

In this way, the free casting apparatus according to the first example embodiment has the pattern P applied to the upper surface of the shape determining member 102, and includes the imaging portion that captures an image of the pattern P that is reflected onto an area near the solidification interface, and an image analyzing portion that determines the solidification interface from this image. Because this pattern P is reflected onto the retained molten metal M2, the brightness of the surface of the retained molten metal M2 greatly changes when the retained molten metal M2 oscillates slightly. Therefore, the solidification interface is able to be determined even if the solidification interface is low and the oscillation of the molten metal is small. As a result, even if the solidification interface is low, feedback control for keeping the solidification interface within the predetermined reference range is able to be performed, so the dimensional accuracy and surface quality of the casting are able to be improved.

Continuing on, a free casting method according to the first example embodiment will be described with reference to FIG. 1.

First, the starter ST is lowered by the up-drawing machine 108 so that it passes through the molten metal passage portion 103 of the shape determining member 102, and the tip end portion of the starter ST is dipped into the molten metal M1.

Next, the starter ST starts to be drawn up at a predetermined speed. Here, even if the starter ST separates from the molten metal surface, the molten metal M1 follows the starter ST and is drawn up from the molten metal surface by the surface film and surface tension, and forms the retained molten metal M2. As shown in FIG. 1, the retained molten metal M2 is formed in the molten metal passage portion 103 of the shape determining member 102. That is, the shape determining member 102 gives the retained molten metal M2 its shape.

Next, the starter ST (or the casting M3 formed by the retained molten metal M2 solidifying) is cooled by cooling gas blown from the cooling gas nozzle 106. As a result, the retained molten metal M2 is indirectly cooled and solidifies progressively from the upper side toward the lower side, thus forming the casting M3. In this way, the casting M3 is able to be continuously cast.

Figure 5:
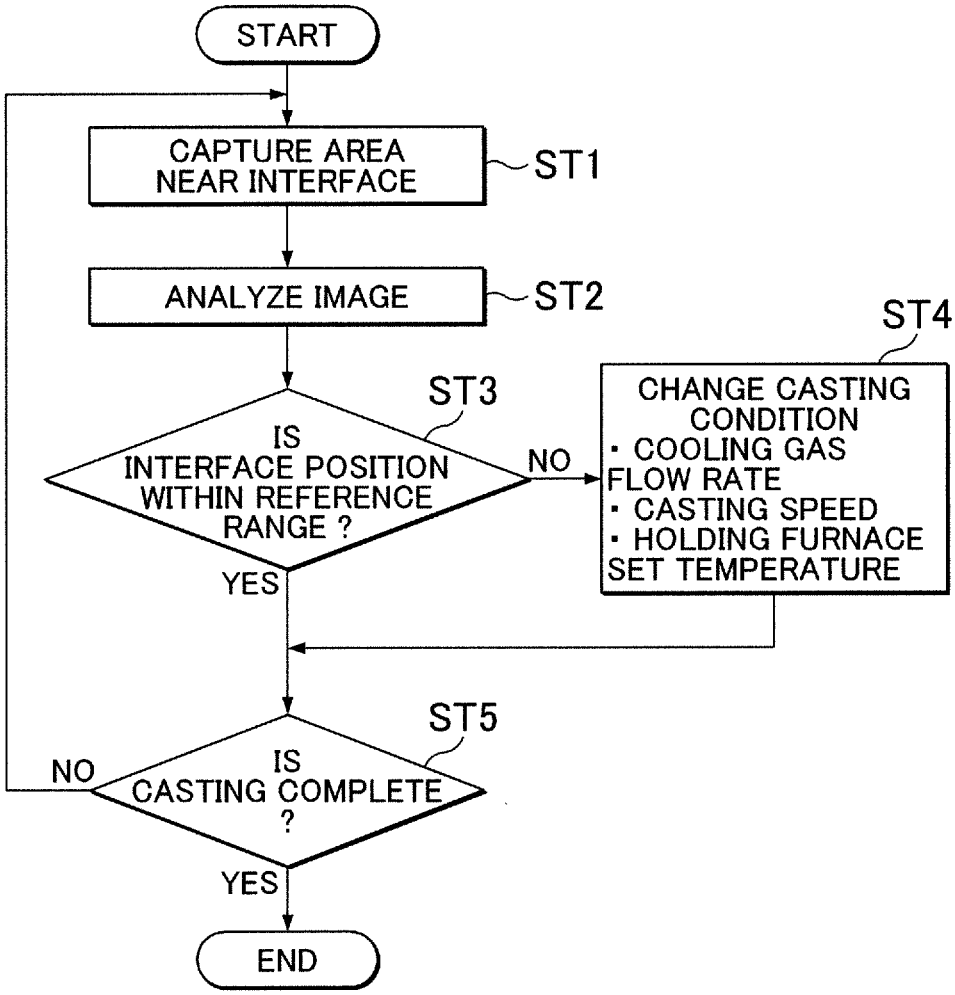
FIG. 5 is a flowchart illustrating a solidification interface control method according to the first example embodiment.

The free casting method according to the first example embodiment controls the solidification interface so as to keep it within a predetermined reference range. Hereinafter, the solidification interface control method will be described with reference to FIG. 5. FIG. 5 is a flowchart illustrating the solidification interface control method according to the first example embodiment.

First, the imaging portion 109 captures an image of the area near the solidification interface (step ST1). Then, the image analyzing portion 110 analyzes the image captured by the imaging portion 109 (step ST2). More specifically, the image analyzing portion 110 determines a location where the brightness value of reflected light changes greatly in short fluctuation cycles, to be the surface of the retained molten metal M2 which oscillates, and determines a location where there is almost no oscillation to be the surface of the casting M3, by comparing a plurality of images captured in succession. Then the image analyzing portion 110 determines the boundary portion between a region where oscillation was detected and a region where oscillation was so small that it was not detected, in the image captured by the imaging portion 109, to be the solidification interface.

Here, the pattern P is applied to the upper surface of the shape determining member 102. This pattern P is reflected onto the retained molten metal M2, so the brightness of the surface of the retained molten metal M2 changes greatly when the retained molten metal M2 oscillates slightly. Therefore, the solidification interface is able to be determined even when the molten metal surface is low and the oscillation of the molten metal surface is small.

Next, the casting controlling portion 111 determines whether the position of the solidification interface determined by the image analyzing portion 110 is within the reference range (step ST3). If the position of the solidification interface is not within the reference range (i.e., NO in step ST3), the casting controlling portion 111 changes one of the conditions, i.e., the cooling gas flow rate, the casting speed, and the holding furnace set temperature (step ST4). Then, the casting controlling portion 111 determines whether casting is complete (step ST5).

More specifically, in step ST4, if the solidification interface determined by the image analyzing portion 110 is above the upper limit, the casting controlling portion 111 reduces the up-drawing speed of the up-drawing machine 108, lowers the set temperature of the molten metal holding furnace 101, or increases the flow rate of cooling gas supplied from the cooling gas supplying portion 107. On the other hand, if the solidification interface determined by the image analyzing portion 110 is below the lower limit, the casting controlling portion 111 increases the up-drawing speed of the up-drawing machine 108, raises the set temperature of the molten metal holding furnace 101, or reduces the flow rate of the cooling gas supplied from the cooling gas supplying portion 107.

If the position of the solidification interface is within the reference range (i.e., YES in step ST3), none of the casting conditions are changed and the process proceeds directly on to step ST5.

If casting is not complete (i.e., NO in step ST5), the process returns to step ST1. On the other hand, if casting is complete (i.e., YES in step ST5), control of the solidification interface ends.

In this way, with the free casting method according to the first example embodiment, the pattern P is applied to the upper surface of the shape determining member 102, and an image of the pattern P reflected onto an area near the solidification interface is captured, and the solidification interface is determined from this image. Because this pattern P is reflected onto the retained molten metal M2, the brightness of the surface of the retained molten metal M2 changes greatly when the retained molten metal M2 oscillates slightly. Therefore, the solidification interface is able to be determined even if the solidification interface is low and oscillation of the molten metal is small. As a result, even if the solidification interface is low, feedback control for keeping the solidification interface within the predetermined reference range is able to be performed, so the dimensional accuracy and surface quality of the casting are able to be improved.

Figure 6:
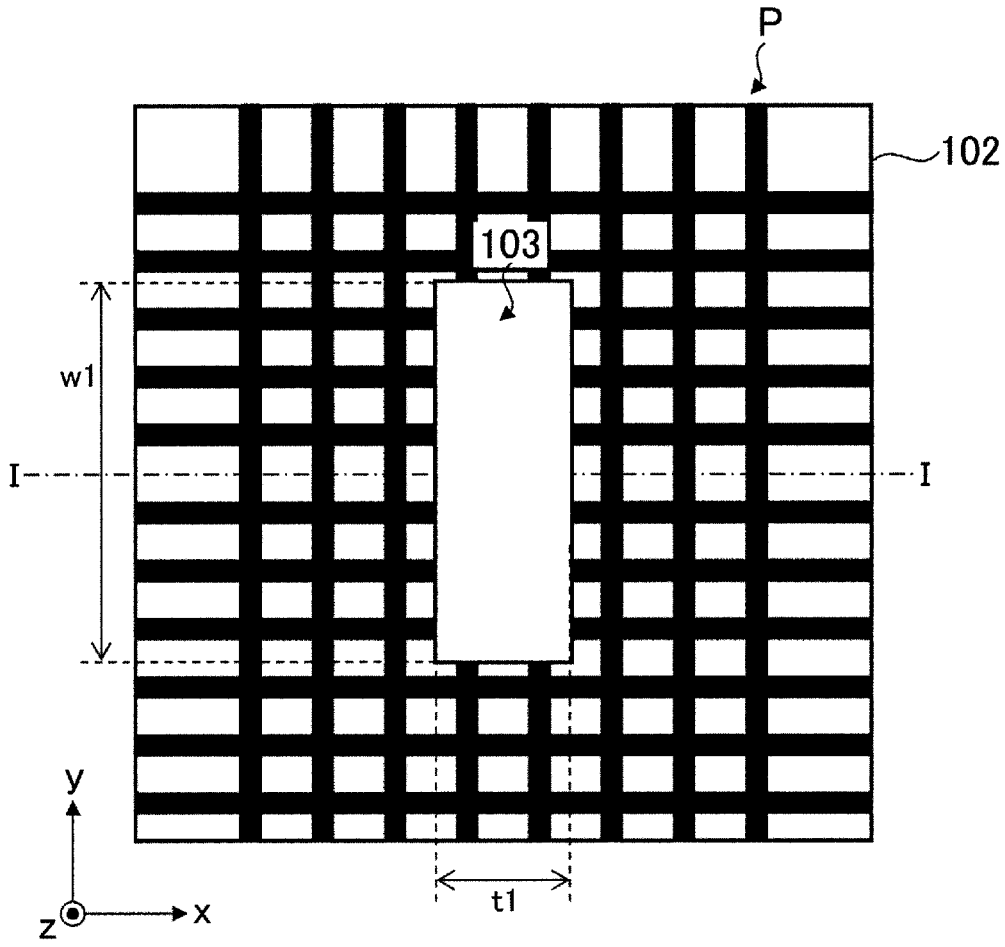
FIG. 6 is a plan view of a modified example of the shape determining member according to the first example embodiment.

In this example embodiment, the pattern P is described as being made up of black and white colors, but it is not limited to this. The pattern P may be made up of any two or more suitable colors. Also, in this example embodiment, an example in which the pattern P is striped is described, but the pattern P is not limited to this. The pattern P may be a pattern of any suitable shape, e.g., a mesh shape such as that shown in FIG. 6.

Figure 7:
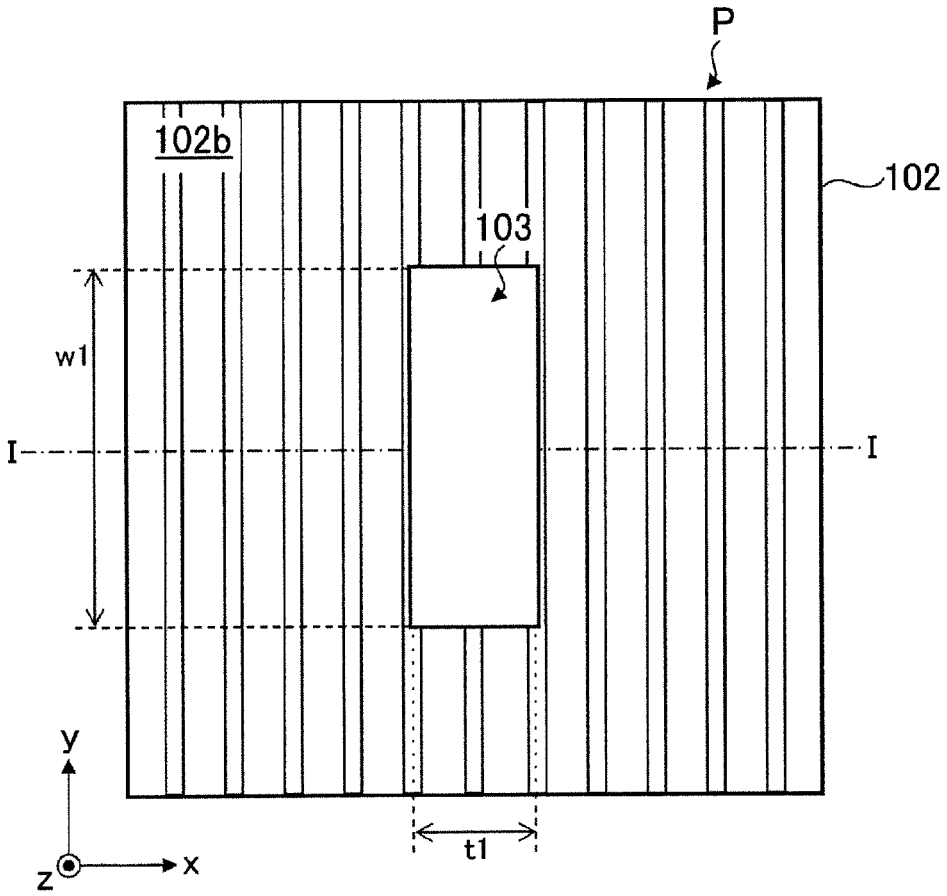
FIG. 7 is a plan view of the modified example of the shape determining member according to the first example embodiment.
Figure 8:
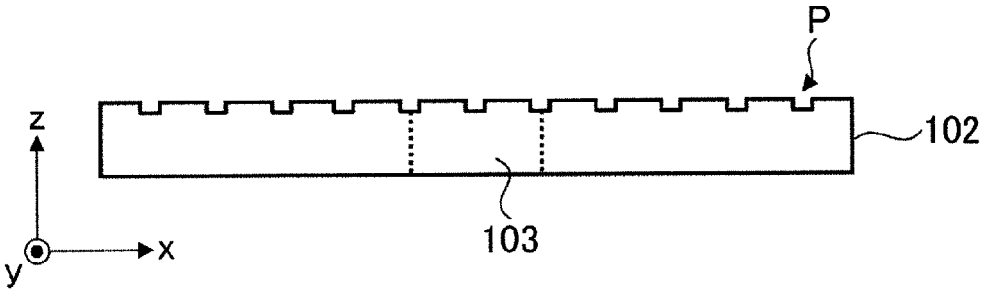
FIG. 8 is a side view of the modified example of the shape determining member according to the first example embodiment.

Alternatively, the pattern P may be formed by applying a serrated shape to the upper surface of the shape determining member 102, as shown in the plan view of FIG. 7 and the side view of FIG. 8. As a result, different brightnesses are able to be distributed onto the upper surface of the shape determining member 102, so the brightness of the surface of the retained molten metal M2 is able to be greatly changed by even the slightest oscillation of the retained molten metal M2, just as with the case in which the pattern P is formed by a plurality of colors. Therefore, the solidification interface is able to be determined even if the solidification interface is low and oscillation of the molten metal is small.

(Test Results)

Continuing on, the inventors changed the height of the solidification interface and measured an interface detection rate, so the test results from this will now be described. Here, the interface detection rate is the ratio of the time for which the image analyzing portion 110 was able to detect the solidification interface to the capturing time by the imaging portion 109.

Figure 9:
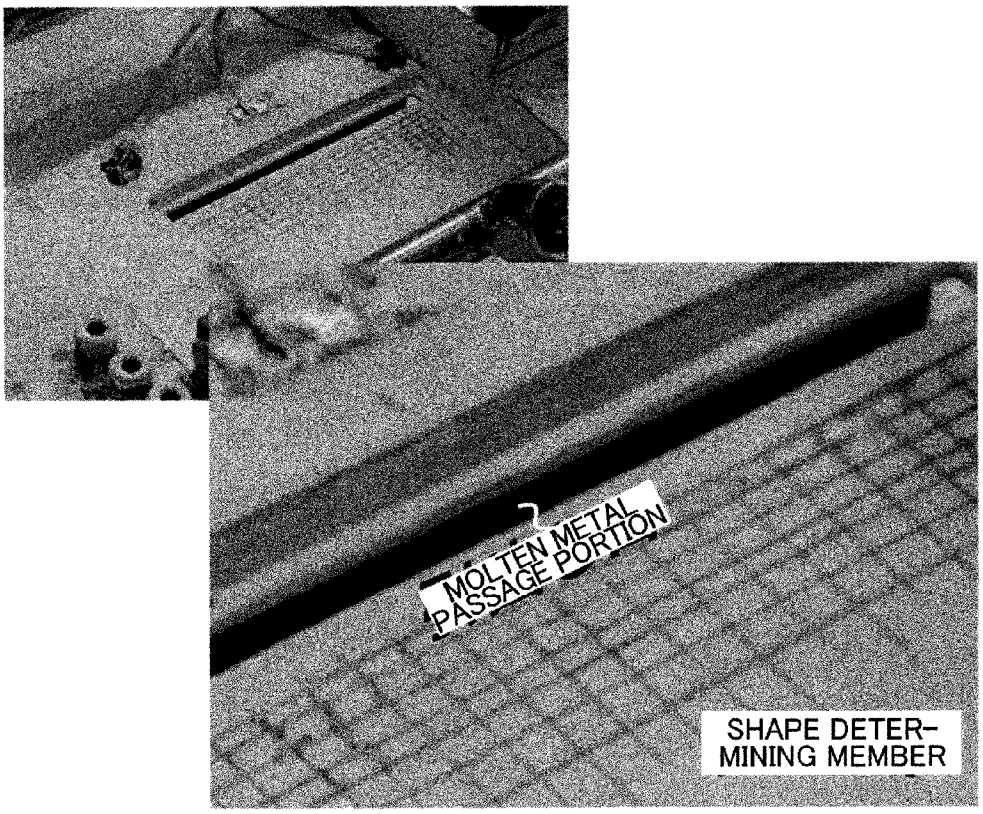
FIG. 9 is a view of an image of the shape determining member used in a test.
Figure 10:
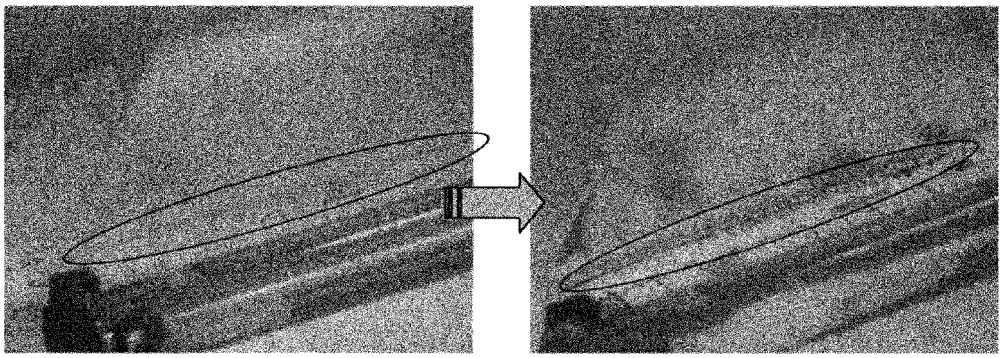
FIG. 10 is a view of example images of an area near the solidification interface in a case in which a pattern is not applied to an upper surface of the shape determining member, and a case in which the pattern is applied to the upper surface of the shape determining member.

In this test, the interface detection rate was measured for a case in which the pattern P was not applied to the upper surface of the shape determining member 102, and a case in which a mesh-shaped pattern P such as that shown in FIG. 9 was applied to the upper surface of the shape determining member 102. FIG. 10 is a view of example images of an area near the solidification interface in a case in which the pattern P was not applied to the upper surface of the shape determining member 102, and a case in which the pattern P was applied to the upper surface of the shape determining member 102. With the case in which the pattern P was applied, it is evident that the pattern P is reflected onto the retained molten metal M2, as shown in FIG. 10.

Figure 11:
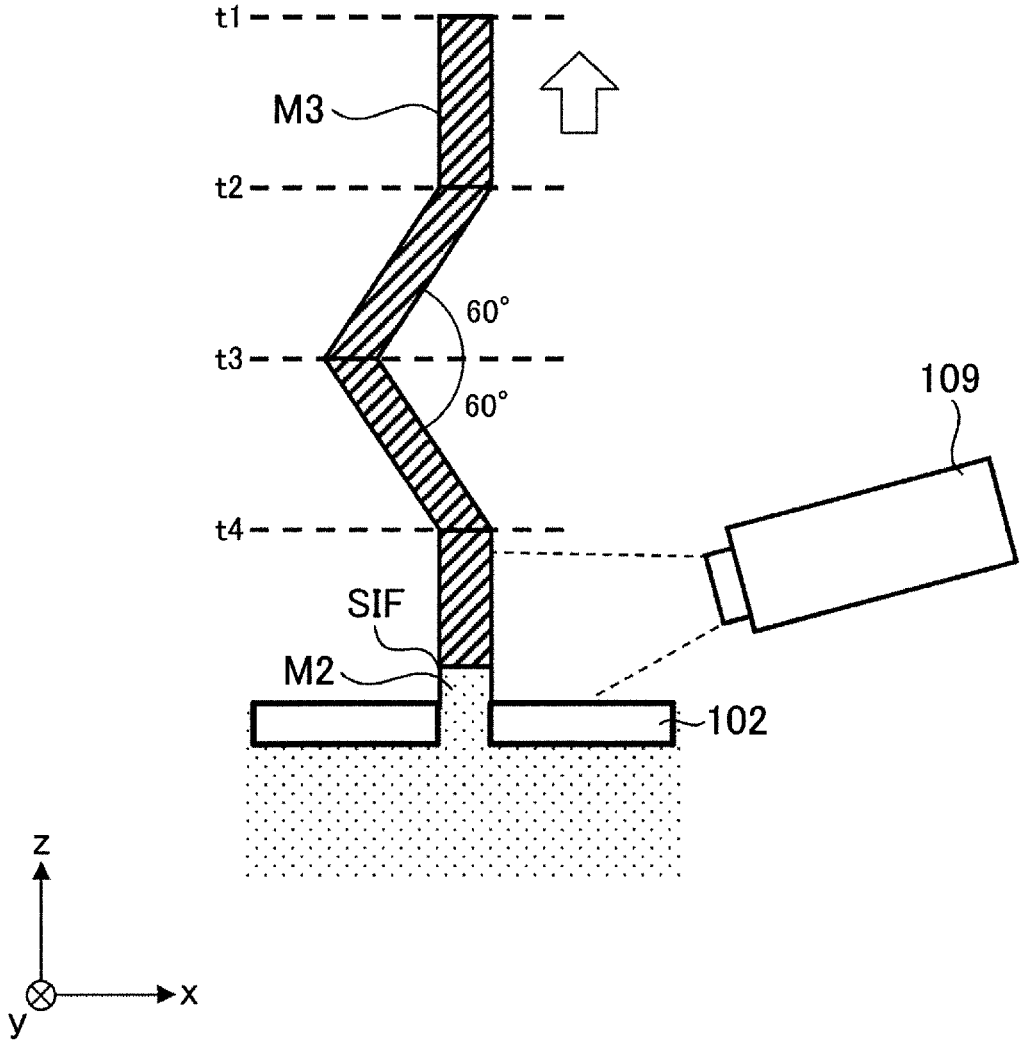
FIG. 11 is a view illustrating a test method.

FIG. 11 is a view illustrating the test method. The xyz coordinates in FIG. 11 are the same as those in FIG. 1. In this test, the imaging portion 109 is arranged so as to capture an image of the minus side from the x-axis direction plus side, as shown in FIG. 11.

First, at time t1 to t2, the molten metal M1 is drawn upward in the vertical direction (i.e., toward the z-axis direction plus side). Next, at time t2 to t3, the molten metal M1 is drawn up inclined toward the x-axis direction plus side with respect to up direction in the vertical direction. At this time, the solidification interface on the side captured by the imaging portion 109 is lower than the solidification interface at time t1 to t2. Lastly, at time t3 to t4, the molten metal M1 is drawn up inclined toward the x-axis direction minus side with respect to up direction in the vertical direction. At this time, the solidification interface on the side captured by the imaging portion 109 is higher than the solidification interface at time t1 to t2.

Figure 12:
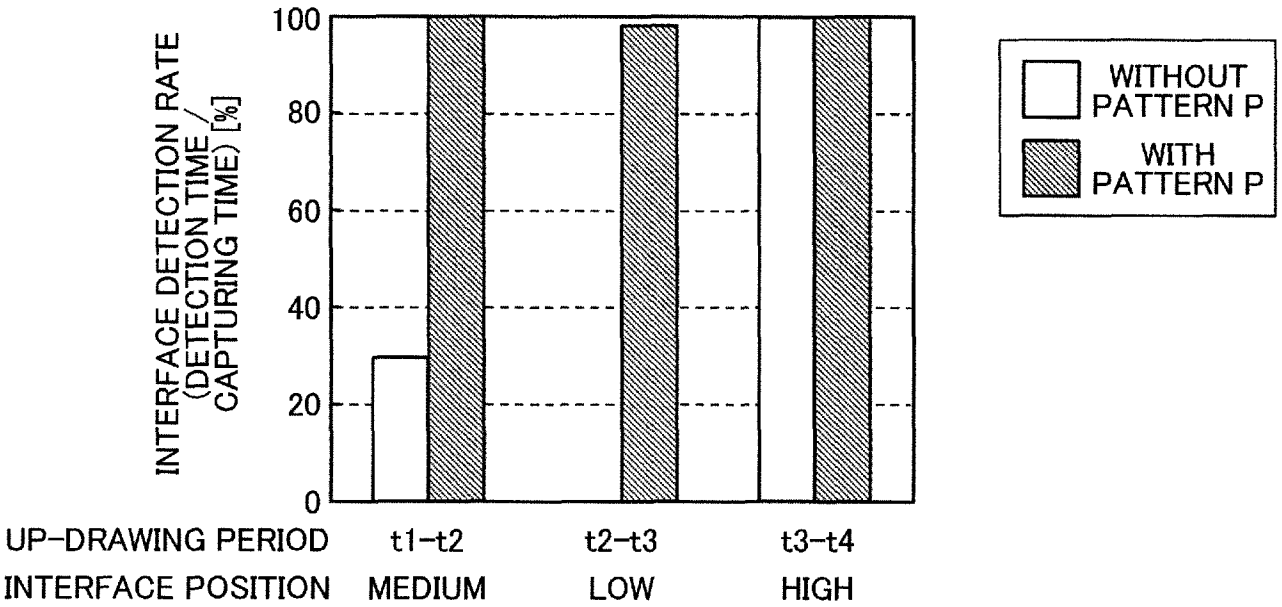
FIG. 12 is a view of the relationship between the position of the solidification interface and interface detection rate.

FIG. 12 is a view of the relationship between the interface detection rate and the position of the solidification interface (i.e., a view of the test results). As shown in FIG. 12, the interface detection rate is extremely low, at 30% or 0%, without the pattern P when the interface position is medium or low. This is because it is difficult to identify the solidification interface without the pattern P when the interface position is relatively low. In contrast, with the pattern P, the interface detection rate is approximately 100% regardless of the interface position (i.e., even when the interface position is low). This is because it is possible to identify the solidification interface, regardless of the interface position, when the pattern P is provided.

Second Example Embodiment

Figure 13:
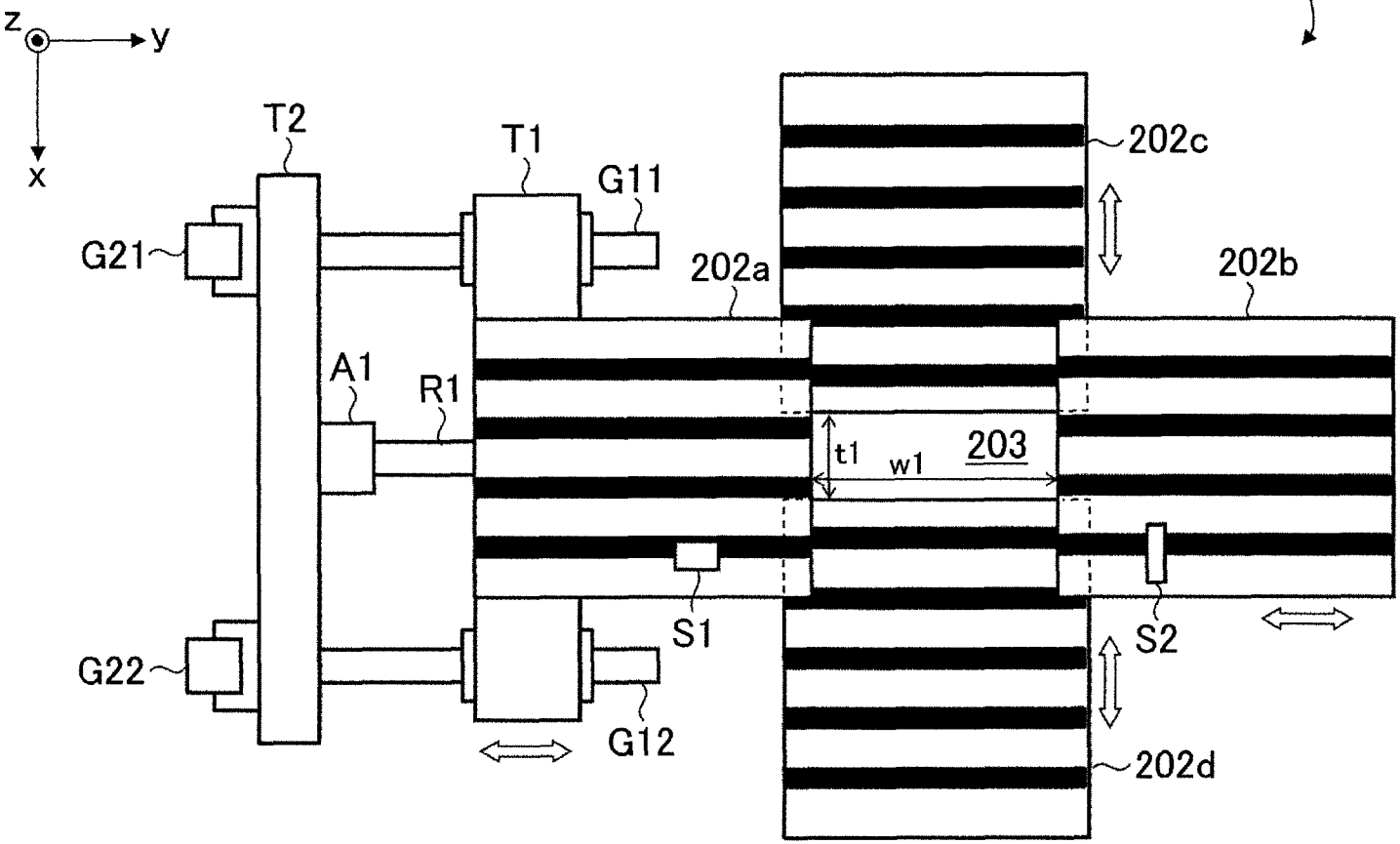
FIG. 13 is a plan view of a shape determining member according to a second example embodiment of the invention.
Figure 14:
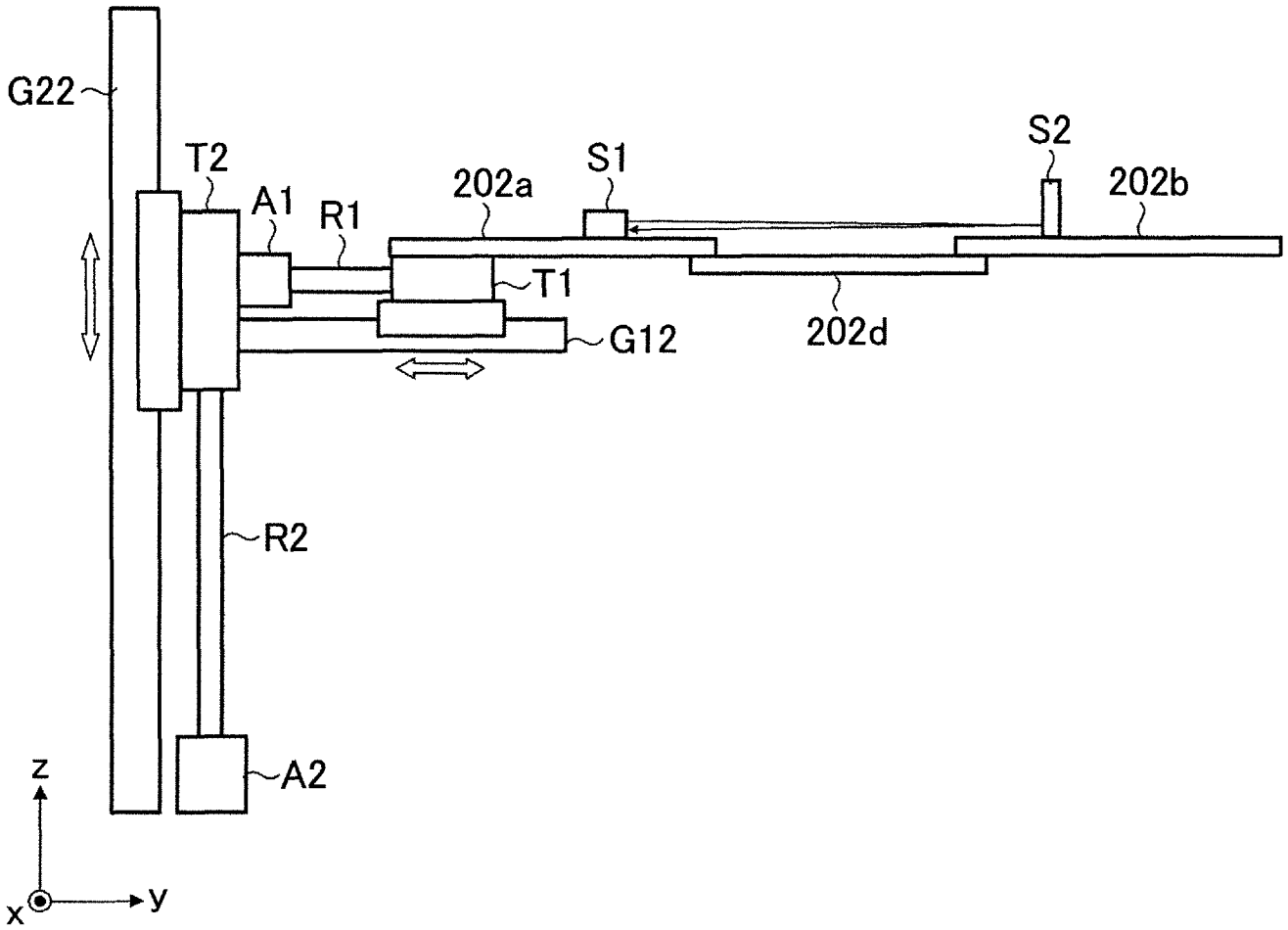
FIG. 14 is a side view of the shape determining member of the second example embodiment.

Next, a free casting apparatus according to a second example embodiment of the invention will be described with reference to FIGS. 13 and 14. FIG. 13 is a plan view of a shape determining member 202 according to the second example embodiment. FIG. 14 is a side view of the shape determining member 202 according to the second example embodiment. The xyz coordinates in FIGS. 13 and 14 also match those in FIG. 1.

The shape determining member 102 according to the first example embodiment shown in FIG. 2 is formed from one plate, so the thickness t1 and width w1 of the molten metal passage portion 103 are fixed. In contrast, the shape determining member 202 according to the second example embodiment includes four rectangular shape determining plates 202*a*, 202*b*, 202*c*, and 202*d*, as shown in FIG. 13. That is, the shape determining member 202 according to the second example embodiment is divided into a plurality of sections. This kind of structure enables the thickness t1 and width w1 of the molten metal passage portion 203 to be changed. Also, the four rectangular shape determining plates 202*a*, 202*b*, 202*c*, and 202*d* are able to be synchronously moved in the z-axis direction. Moreover, the pattern P is applied to the upper surface of the shape determining member 202, similar to the shape determining member 102.

As shown in FIG. 13, the shape determining plates 202*a* and 202*b* are arranged facing each other lined up in the y-axis direction. Also, as shown in FIG. 14, the shape determining plates 202*a* and 202*b* are arranged at the same height in the z-axis direction. The distance between the shape determining plates 202*a* and 202*b* determines the width w1 of the molten metal passage portion 203. The shape determining plates 202*a* and 202*b* are able to move independently in the y-axis direction, so they are able to change the width w1.A laser displacement gauge S1 may be provided on the shape determining plate 202*a*, and a laser reflecting plate S2 may be provided on the shape determining plate 202*b*, as shown in FIGS. 13 and 14, in order to measure the width w1 of the molten metal passage portion 203.

Also, as shown in FIG. 13, the shape determining plates 202*c* and 202*d* are arranged facing each other lined up in the x-axis direction. Also, the shape determining plates 202*c* and 202*d* are arranged at the same height in the z-axis direction. The distance between the shape determining plates 202*c* and 202*d* determines the thickness t1 of the molten metal passage portion 203. Also, the shape determining plates 202*c* and 202*d* are able to move independently in the x-axis direction, so they are able to change the thickness t1. The shape determining plates 202*a* and 202*b* are arranged contacting upper sides of the shape determining plates 202*c* and 202*d*.

Next, the drive mechanism of the shape determining plate 202*a* will be described with reference to FIGS. 13 and 14. As shown in FIGS. 13 and 14, the drive mechanism of the shape determining plate 202*a* includes slide tables T1 and T2, linear guides G11, G12, G21, and G22, actuators A1 and A2, and rods R1 and R2. The shape determining plates 202*b*, 202*c*, and 202*d* also each include a drive mechanism, similar to the shape determining plate 202*a*, but these are not shown in FIGS. 13 and 14.

As shown in FIGS. 13 and 14, the shape determining plate 202*a* is placed on and fixed to the slide table T1 that is able to slide in the y-axis direction. The slide table T1 is slidably placed on the pair of linear guides G11 and G12 that extend parallel to the y-axis direction. Also, the slide table T1 is connected to the rod R1 that extends in the y-axis direction from the actuator A1. This kind of structure enables the shape determining plate 202*a* to slide in the y-axis direction.

Also, as shown in FIGS. 13 and 14, the linear guides 11 and 12, and the actuator A1, are placed on and fixed to the slide table T2 that is able to slide in the z-axis direction. The slide table T2 is slidably placed on the pair of linear guides G21 and G22 that extend parallel to the z-axis direction. Also, the slide table T2 is connected to the rod R2 that extends in the z-axis direction from the actuator A2. The linear guides G21 and G22, and the actuator A2, are fixed to a horizontal floor or base, not shown, or the like. This kind of structure enables the shape determining plate 202*a* to slide in the z-axis direction. The actuators A1 and A2 may be hydraulic cylinders, air cylinders, or electric motors or the like, for example.

Figure 15:
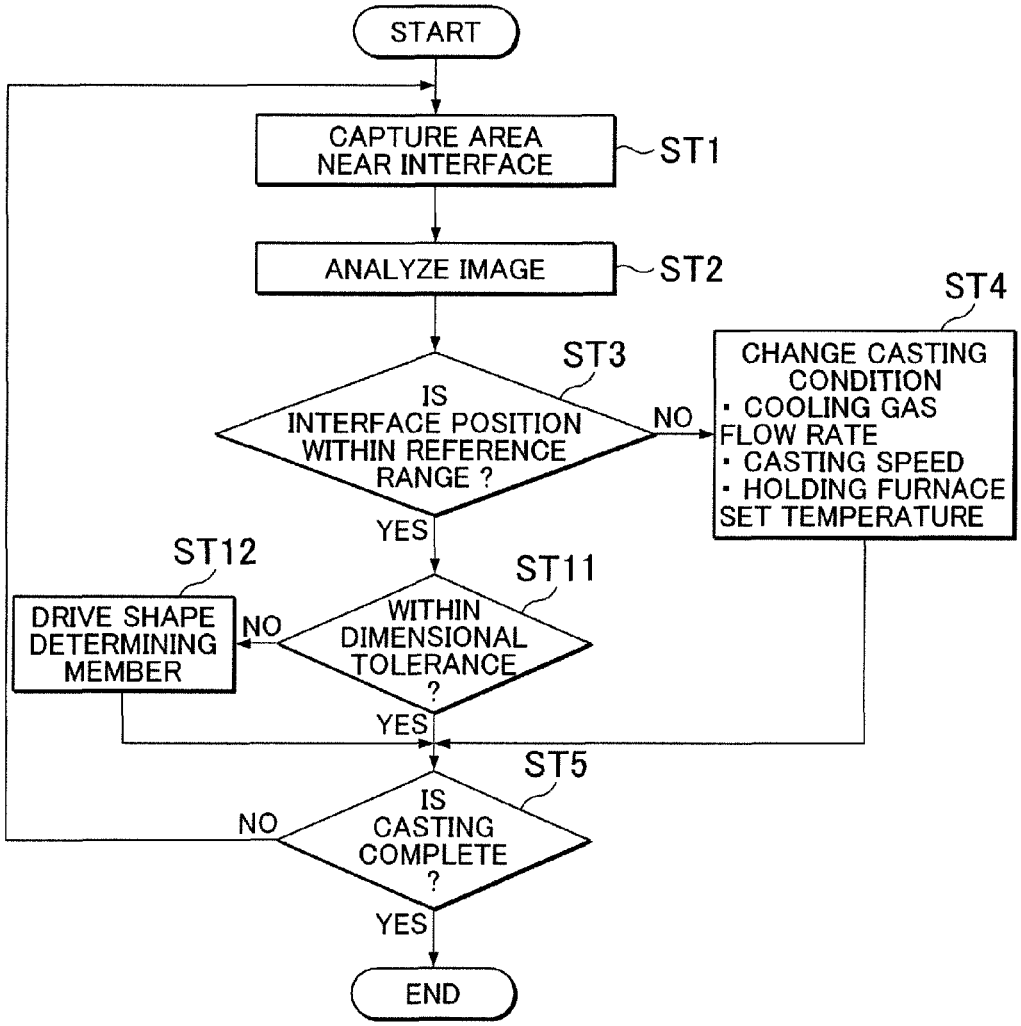
FIG. 15 is a flowchart illustrating a solidification interface control method according to the second example embodiment.

Next, a solidification interface control method according to the second example embodiment of the invention will be described with reference to FIG. 15. FIG. 15 is a flowchart illustrating the solidification interface control method according to the second example embodiment. In FIG. 15, the steps up to step ST4 are the same as those in the first example embodiment shown in FIG. 5, so a detailed description of these steps will be omitted.

If the position of the solidification interface is within the reference range (i.e., YES in step ST3), the casting controlling portion 111 determines whether the dimensions (i.e., the thickness t and the width w) at the solidification interface determined by the image analyzing portion 110 are within the dimensional tolerance of the casting M3 (step ST11). Here, the dimensions (i.e., the thickness t and the width w) at the solidification interface are obtained simultaneously when the image analyzing portion 110 determines the solidification interface. If the dimensions obtained from the image are not within the dimensional tolerance (i.e., NO in step ST11), the thickness t1 and the width w1 of the molten metal passage portion 103 are changed (step ST12). Then the casting controlling portion 111 determines whether casting is complete (step ST5).

If the dimensions are within the dimensional tolerance (i.e., YES in step ST11), the process proceeds directly on to step ST5 without changing the thickness t1 and the width t1 of the molten metal passage portion 103. If casting is not complete (i.e., NO in step ST5), the process returns to step ST1. On the other hand, if casting is complete (i.e., YES in step ST5), control of the solidification interface ends. The other structure is the same as that in the first example embodiment, so a description thereof will be omitted.

In this way, with the free casting method according to the second example embodiment, the pattern P is applied to the upper surface of the shape determining member 202, an image of the pattern P that is reflected onto an area near the solidification interface is captured, and the solidification interface is determined from this image, similar to the first example embodiment. Because the pattern P is reflected onto the retained molten metal M2, the brightness of the surface of the retained molten metal M2 greatly changes when the retained molten metal M2 oscillates slightly. Therefore, the solidification interface is able to be determined even when the solidification interface is low and oscillation of the molten metal is small. As a result, even if the solidification interface is low, feedback control for keeping the solidification interface within the predetermined reference range is able to be performed, so the dimensional accuracy and surface quality of the casting are able to be improved.

Furthermore, with the free casting method according to the second example embodiment, the thickness t1 and the width w1 of the molten metal passage portion 203 of the shape determining member 202 are able to be changed. Therefore, when determining the solidification interface from the image, the thickness t and the width w at the solidification interface are measured, and the thickness t1 and the width w1 of the molten metal passage portion 203 are changed if this measured value is not within the dimensional tolerance. That is, feedback control for keeping the dimensions of the casting within the dimensional tolerance is able to be performed. As a result, the dimensional accuracy of the casting is able to be improved even more.

The invention is not limited to the example embodiments described above, and may be modified as appropriate without departing from the spirit of the invention.

What is claimed is:

1. An up-drawing continuous casting apparatus comprising:

a holding furnace that holds molten metal;

a shape determining member that is arranged above a molten metal surface of the molten metal held in the holding furnace, and that determines a sectional shape of a cast casting by the molten metal passing through the shape determining member, the shape determining member including a pattern provided on an upper surface of the shape determining member;

an imaging portion configured to capture an image of the pattern that is reflected onto both retained molten metal that has passed through the shape determining member, and the casting formed by the retained molten metal solidifying;

an image analyzing portion configured to determine a solidification interface from the image; and a casting controlling portion configured to change a casting condition when the solidification interface determined by the image analyzing portion is not within a predetermined reference range.

2. The up-drawing continuous casting apparatus according to claim 1, wherein the imaging portion is arranged in a position where the imaging portion is able to capture the pattern reflected onto both the retained molten metal and the casting; and the pattern is provided on the shape determining member in a position where the imaging portion is able to capture the pattern reflected onto both the retained molten metal and the casting.

3. The up-drawing continuous casting apparatus according to claim 1, wherein the pattern includes a plurality of colors.

4. The up-drawing continuous casting apparatus according to claim 1, wherein the pattern includes a serrated shape provided on an upper surface of the shape determining member.

5. The up-drawing continuous casting apparatus according to claim 1, wherein the pattern is striped or mesh-shaped.

6. The up-drawing continuous casting apparatus according to claim 1, wherein the casting condition is one of a flow rate of cooling gas for cooling the retained molten metal that has passed through the shape determining member, an up-drawing speed of the casting, and a set temperature of the holding furnace.

7. The up-drawing continuous casting apparatus according to claim 1, wherein the shape determining member is divided into a plurality of sections, and is able to change the sectional shape;

the image analyzing portion is configured to detect a dimension of the casting from the image; and the casting controlling portion is configured to change the sectional shape determined by the shape determining member, when the dimension is not within a dimensional tolerance.

8. An up-drawing continuous casting method that includes arranging a shape determining member that determines a sectional shape of a cast casting above a molten metal surface of molten metal held in a holding furnace, and drawing up the molten metal while passing the molten metal through the shape determining member, the shape determining member including a pattern provided on an upper surface of the shape determining member, the up-drawing continuous casting method comprising:

capturing an image of the pattern that is reflected onto both retained molten metal that has passed through the shape determining member, and the casting formed by the retained molten metal solidifying;

determining a solidification interface from the image; and changing a casting condition when the determined solidification interface is not within a predetermined reference range.

* * * * *